United States Patent [19]

Kaufman

[11] 4,250,481

[45] Feb. 10, 1981

[54] VARIABLE RESISTANCE DEVICE FOR THICK FILM CIRCUITRY

[76] Inventor: Lance R. Kaufman, 131 White Oak Way, Mequon, Wis. 53092

[21] Appl. No.: 962,590

[22] Filed: Nov. 21, 1978

[51] Int. Cl.[3] ..... H01C 10/32

[52] U.S. Cl. ..... 338/163; 338/174; 338/202

[58] Field of Search ..... 338/160, 162, 163, 171, 338/174, 202, 164, 166, 184, 199

[56] References Cited

U.S. PATENT DOCUMENTS

| | | | |
|---|---|---|---|
| 2,177,290 | 10/1939 | Schellenger | 338/171 |
| 2,811,621 | 10/1957 | Mucher et al. | 338/174 X |
| 2,858,397 | 10/1958 | Littleton | 338/174 X |
| 2,925,575 | 2/1960 | Barden | 338/166 |
| 3,032,734 | 5/1962 | Zunker et al. | 338/163 |
| 3,389,364 | 6/1968 | Budd et al. | 338/174 |

FOREIGN PATENT DOCUMENTS

| | | | |
|---|---|---|---|
| 439189 | 6/1976 | United Kingdom | 338/174 |

OTHER PUBLICATIONS

German Printed Publication 26541, Mertig.

*Primary Examiner*—C. L. Albritton

*Attorney, Agent, or Firm*—Andrus, Sceales, Starke & Sawall

[57] ABSTRACT

A variable resistance device includes a thick film electrical conductor affixed to the underside of a supporting substrate and extending circumferentially around a hole. A radially spaced, film-like resistor surrounds the electrical conductor. A knob has a disc bearing on the top side of the substrate and a pair of projections extending through the hole to journal the knob in the substrate and to mount a carrier adjacent the underside of the substrate. A wiper means is mounted on the upper surface of the carrier for engaging the electrical conductor and resistor to vary the resistance of the device responsive to rotation of the knob through a manipulative means.

2 Claims, 3 Drawing Figures

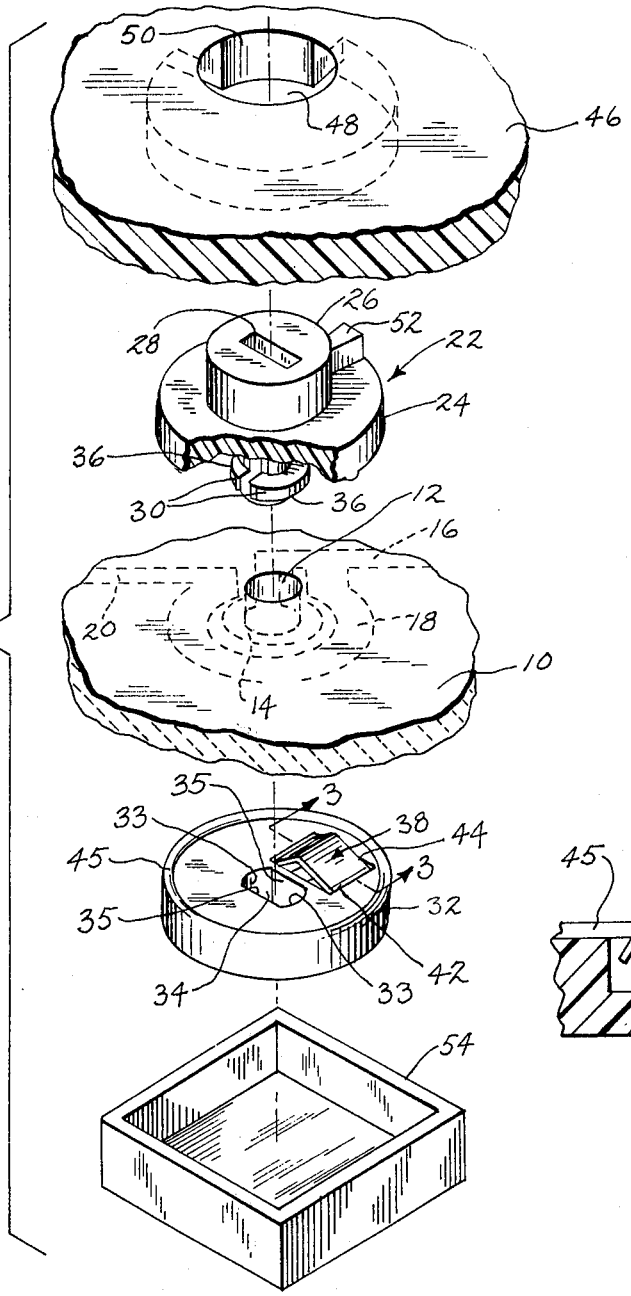
Fig. 1
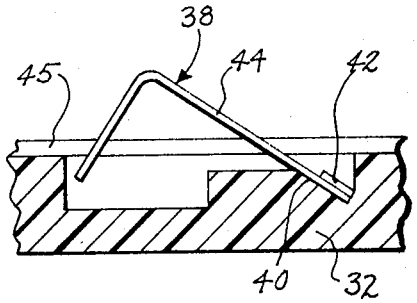
Fig. 3
Fig. 2
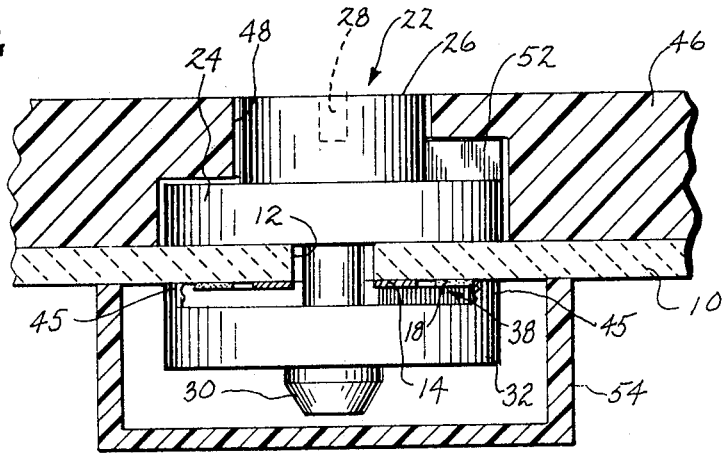

VARIABLE RESISTANCE DEVICE FOR THICK FILM CIRCUITRY

BACKGROUND AND SUMMARY OF THE PRESENT INVENTION

The present invention relates to mechanically variable resistance elements having elements thereof applied to a base.

The use of printed circuitry, and particularly thick film techniques, in electronic circuitry permits a substantial reduction in their size. However, certain electronic components, including rheostats or potentiometers cannot be produced by such techniques. There has thus arisen a need for elements of this type which may be contructed on a scale commensurate with that of the miniaturized thick film circuitry.

It is, therefore, the object of the present invention to provide a variable resistance device which, while not so limited, finds particular utility in miniaturized thick film circuitry, as by utilizing elements integrally formed in such circuitry. The device of the present invention is small in size, simple in construction and easy to disassemble for inspection or other purposes.

The variable resistance device of the present invention includes a thick film electrical conductor affixed to the underside of a supporting substrate and extending around a hole in the substrate. A resistor element, which may also be film-like, is affixed to the underside of the substrate radially spaced from the conductor. A knob has a disc bearing on the top side of the substrate and a cylinder containing a slot or other tool responsive configuration by which the knob may be rotated. A pair of projections depend from the bottom of the disc and extend through and beyond the hole. The projections may comprise chord-like portions of the cylindrical form of the hole. A carrier plate is mounted on the lower ends of the projections adjacent the underside of the substrate. The carrier is rotatable with the knob.

A wiper, typically having a plurality of brushes, is mounted on the upper surface of the carrier to engage and electrically connect the conductor and resistor element. The wiper is positioned along the resistance element by rotation of the knob to establish the resistance of the device. The projections may be bent inwardly to remove the carrier, affording rapid and easy inspection, replacement of parts and dismantling of the device. The device may be covered by a casing on the top side of the substrate through which the slot containing cylinder extends. A cover on the underside of the substrate protects the plate, wiper, conductor and resistor element.

BRIEF DESCRIPTION OF THE DRAWINGS

FIG. 1 is an exploded perspective view of the improved variable resistance device of the present invention;

FIG. 2 is a cross-sectional view taken through the device; and

FIG. 3 is a section taken along the lines 3—3 and showing the connection of the brush to the contact carrier.

DETAILED DESCRIPTION OF THE PREFERRED EMBODIMENT

In FIG. 1, a substrate incorporated in the variable resistance device of the present invention is indicated by the numeral 10. Substrate 10 is typically a non-conductive material, such as glass reinforced plastic or preferable ceramic, having a hole 12 drilled or punched therein. As shown in FIGS. 1 and 2, a generally circular thick film conductor 14 is applied to the underside of substrate 10 around hole 12. Conductor 14 incorporates conductor 16 leading to other portions of a circuit, not shown. A resistor element 18, which may also be of thick film, is applied to the lower surface of substrate 10 to surround conductor 14. The end of resistor element 18 may be connected to conductor 20 and to the conductor film 16.

A knob 22 is provided for adjusting the resistance of the variable resistance device of the present invention. Knob 22 includes a centrally located disc 24 which, as shown most clearly in FIG. 2 bears on the upper surface of substrate 10. A cylinder 26 mounted on top of disc 24 contains slot 28 in which a screwdriver or other manipulative tool may be inserted to rotate knob 22.

A pair of projections 30 depend from the bottom of disc 24 and extend through and beyond hole 12. Projections 30 are preferably the exterior segments of a cylindrical form established by a pair of bifurcated parallel chords. The interior portion of the cylindrical form is removed, as shown in FIG. 1. The cylindrical form corresponds to hole 12 so that projections 30 journal knob 22 in hole 12.

A carrier 32 is mounted on the portions of projection 30 extending through substrate 10 for rotation with knob 22. For this purpose, carrier 32 provides a central aperture 34 to receive projections 30. Aperture 34 has a pair of opposed arcuate portions 33 corresponding to the exterior of projections 30 and a pair of opposed rectilinear portions 35 corresponding generally to the removed central portion between projections 30 so that when projections 30 are placed in aperture 34, plate 32 rotates with knob 22. The lower ends of projections 30 each have an exterior rim 36 for retaining carrier 32 on the projections. Knob 22 is typically formed of plastic or similar material having sufficient flexibility to permit projections 30 to be bent inwardly, permitting carrier 32 to be removed from the projections when rims 36 clear the periphery of aperture 34. This permits easy disassembly of the variable resistance device when necessary and "snap together" reassembly.

As shown most clearly in FIG. 1, wiper 38 is mounted on the upper surface of carrier 32 to engage conductor 14 and resistor element 18. For this purpose a prism-shaped notch 40 is provided in the upper surface of carrier 32. Wiper 38 includes bar 42 haaving a plurality of contiguous fine-wire brushes 44 attached thereto. Bar 42 and brushes 44 are fastened to the slanting surface of notch 40 with brushes 44 lying along the upper surface of carrier 32 and biased upwardly against conductor 14 and resistor element 18 to provide a conductive path between the two. The carrier 32 also provides one or more upstanding ridges 45 which rotatably engage a portion of substrate 10 in operation.

A housing 46 for substrate 10 may be placed on top of the substrate and includes bore 48 for receiving disc 24 and cylinder 28 with slot 28 exposed. Bore 48 may include stop 50 which co-acts with projection 52 on disc 24 to control the amount of rotation of knob 22 to correspond, for example, with the accurate length of resistor element 18. Cover 54 may be placed on the underside of substrate 10 to protect carrier 32, wiper 38, conductor 14, and resistor element 18 from dust, dirt, or other contaminants. Cover 54 also permits the underside surface of substrate 10 to be covered with a potting compound, if desired, without interfering with the operation of the variable resistance device.

In operation, conductors 16 and 20 are appropriately connected in the circuitry on substrate 10. A screwdriver is inserted in slot 28 of knob 22 for rotation to position wiper 38, which connects resistor element 18 to conductor 14, at a location along the resistor element corresponding to the resistance desired from the variable resistance element.

While the variable resistance device of the present invention may find use in a wide variety of applications, its simplicity of construction permits it to reach its greatest utility in connection with miniaturized thick film circuits mounted on a ceramic substrate. The size of the variable resistance device is appropriately reduced so that, for example, the diameter of disc 26 is less than 0.5 inch and the other portions of the variable resistance device are correspondingly dimensioned.

It will be appreciated that the position of conductor 14 and resistor element 18 on substrate 10 may be reversed from that shown in FIGS. 1 and 2, if necessary or desirable. The variable resistance device can be employed with thick film circuits such as illustrated in U.S. Pat. No. 3,958,075.

Various modes of carrying out the invention are contemplated as being within the scope of the following claims particularly pointing out and distinctly claiming the subject matter which is regarded as the invention.

I claim:

1. A variable resistance device for use in miniaturized thick film circuitry located on a continuous insulating substrate, comprising thick film circuit means (16, 20) on a first side of said substrate (10) connected in circuit with said miniaturized thick film circuitry and including first and second spaced conductive films (14, 18) having different electrical impedances located adjacent an opening (12) within said continuous insulating substrate (10), and impedance control means including a carrier having an opening removably connected to said substrate and including impedance varying means (32, 38) located adjacent said first side and providing circuit means (38) engaging said first and second films and movable with respect to at least one of said first and second film to vary the impedance in said thick film circuit, and a control member (22) journalled for movement within said opening and including a first portion (30, 36) formed to engage said impedance varying means and including a flexible projection extending through and beyond said carrier opening to present a part thereof that is exposed when said variable resistance device is assembled to permit removal of said impedance varying means and disassembly of said variable resistance device by manipulation, said part being selectively manipulatable between an expanded first position in which said first control member portion engages said carrier to maintain the engagement of said circuit means with said first and second films and a contracted second position in which said first control member portion disengages said carrier to remove said impedance varying means from said substrate, said control member including a second portion (24, 26) located adjacent a second side of said substrate to move said removably connected impedance varying means to vary the impedance in said thick film circuit in response to movement of said second portion.

2. The variable resistance device of claim 1 wherein said first control member portion includes a pair of flexible spaced bifurcated portions each having a radially extending tab to selectively engage said carrier in said first position and which are released from said carrier in said second position.

* * * * *